US005495082A

United States Patent [19]

Zaffetti et al.

[11] Patent Number: 5,495,082

[45] Date of Patent: Feb. 27, 1996

[54] HANDLE INTERLOCK ARRANGEMENT FOR HIGH AMPERE-RATED CIRCUIT BREAKER OPERATING HANDLES

[75] Inventors: Mark A. Zaffetti, Windsor Locks; Roger N. Castonguay, Terryville; James L. Rosen, West Hartford, all of Conn.

[73] Assignee: General Electric Company, New York, N.Y.

[21] Appl. No.: 265,877

[22] Filed: Jun. 27, 1994

[51] Int. Cl.[6] ..... H01H 5/00

[52] U.S. Cl. ..... 200/400; 200/318

[58] Field of Search ..... 200/400, 401, 200/318, 320, 321, 327; 74/2

[56] References Cited

U.S. PATENT DOCUMENTS

| | | | |
|---|---|---|---|
| 3,689,721 | 9/1972 | Patel | 200/400 |
| 3,689,731 | 9/1972 | McGuffie | 200/400 |
| 4,001,742 | 1/1977 | Castonguay et al. . | |
| 4,658,323 | 4/1987 | Dougherty . | |
| 4,801,907 | 1/1989 | Kelaita, Jr. et al. . | |

OTHER PUBLICATIONS

Castonguay et al, "Operating Mechanism for High Ampere–rated Circuit"; U.S. Ser. No.: 08/202,140 (Docket: 41PR–7116) Feb. 25, 1994.

Castonguay et al, "Handle Operator Assembly for High Ampere–rated Circuit Breaker" U.S. Ser. No.: 08/214,522 (Docket: 41PR–7130) Mar. 18, 1994.

Castonguay et al, "A Latching Arrangement for High–rated Circuit Breaker Operating Springs"; U.S. Ser. No.: 08/218,287(Docket:41PR–7131) Mar, 28, 1994.

Castonguay et al, "Rating Module Unit for High Ampere–rated Circuit Breaker" U.S. Ser. No.: 08/203,062 (Docket:41PR–7124) Feb. 28, 1994.

Castonguay et al, "An Interlock Arrangement for High Ampere–rated Circuit Breaker Operating Handles" U.S. Ser. No.: 08/266,409 (Docket:41PR–7138X) Jun. 27, 1994.

*Primary Examiner*—Henry J. Recla
*Assistant Examiner*—David J. Walczak
*Attorney, Agent, or Firm*—Richard A. Menelly

[57] ABSTRACT

This invention relates to a high ampere-rated circuit breaker which meets the electrical code requirements of the world market. The charging of the powerful operating springs controlling the circuit breaker contacts is made manually by means of an operating handle and a ratchet and pawl assembly. A two-stage latching arrangement controls the retention and release of the pawl to retain and discharge the operating springs. The operating springs cannot become discharged until and unless the operating handle is in a fully retracted position.

12 Claims, 3 Drawing Sheets

HANDLE INTERLOCK ARRANGEMENT FOR HIGH AMPERE-RATED CIRCUIT BREAKER OPERATING HANDLES

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140 Feb. 25, 1994 entitled "Operating mechanism for high ampere-rated circuit breaker" describes an operating mechanism capable of immediately closing the circuit breaker operating mechanism to reclose the contacts without having to recharge the circuit breaker operating springs immediately after opening the circuit breaker contacts.

U.S. patent application Ser. No. 08/203,062 filed on Feb. 28, 1994 entitled "Rating module unit for high ampere-rated circuit breaker" describes a circuit breaker closing spring modular unit whereby the circuit breaker operating springs are contained within a separate unit from the operating mechanism and can be installed within the circuit breaker enclosure without disturbing the operating mechanism assembly.

U.S. patent application Ser. No. 08/214,522 filed Mar. 18, 1994 entitled "Handle Operator Assembly for High Ampere-rated Circuit Breaker" describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, the means employed to release the pawl to allow the closing springs to become fully operational is described within U.S. patent application (41PR7138X) entitled "An Interlock Arrangement for High Ampere-rated Circuit Breaker Operating Handles".

U.S. patent application Ser. No. 08/218,287 filed Mar. 28, 1994 entitled "A Latching Arrangement for High Ampere-rated Circuit Breaker Operating Springs" describes a two-stage latching arrangement that controls the retention and release of a ratchet pawl to retain and discharge the operating springs.

The externally-accessible operating handle that allows manually charging the circuit breaker operating springs to the fully-charged condition must be interlocked to insure that the operating handle is not displaced when the operating springs are released.

One purpose of the invention is to describe a simple and inexpensive arrangement to prevent the operating springs from becoming released when the operating handle is extended while allowing the operating springs to be released when the operating handle is completely retracted.

SUMMARY OF THE INVENTION

The two-stage latching arrangement that controls the retention and release of the circuit breaker operating springs are interfaced with the circuit breaker operating handle through a handle interlock assembly. The operating springs are prevented from becoming released until and unless the operating handle is in a fully retracted position. The operating handle interlock is in the form of a cam-shaped surface at one end of the operating handle that interferes with a cam-follower tab at one end of the two-stage latching lever.

DESCRIPTION OF THE PREFERRED EMBODIMENT

Figure 1:
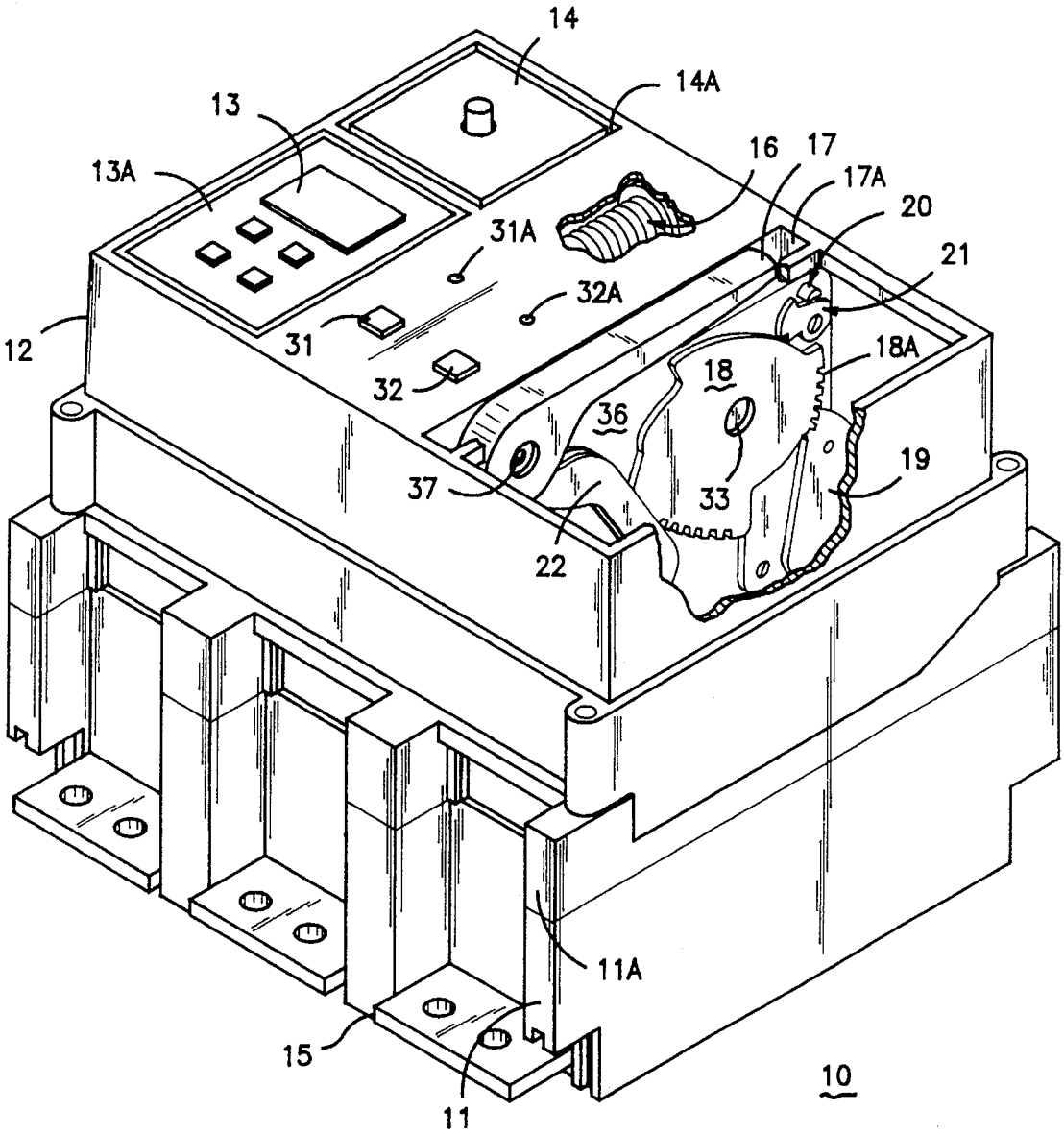
FIG. 1 is a top perspective view of a high ampere-rated circuit breaker with a portion of the circuit breaker cover removed to depict the operating mechanism latch assembly that interacts with the operating handle interlock assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 11A of similar insulative material is attached prior to attaching the top cover 12, also consisting of an electrically-insulative material. Electrical connection with the interior current-carrying components is made by load terminal straps 15 extending from one end of the base and line terminal straps (not shown) extending from the opposite end thereof. The interior components are controlled by an electronic trip unit 13 contained within a recess 13A in the top surface of the top cover 12. Although not shown herein, the trip unit is similar to that described within U. S. Pat. No. 4,658,323 and interacts further with an accessory 14 contained within the accessory recess 14A as described, for example within U.S. Pat. No. 4,801,907. The operating mechanism as described within the aforementioned U.S. patent application 08/203,062 includes a closing shaft 33 which interacts with the powerful operating mechanism closing spring 16. The operating handle 17 located within the handle recess 17A is attached to the operating mechanism sideframe 36 by the handle pivot 37 to provide manual means for charging the operating mechanism spring through operation of the handle drive lever 22 and the handle drive gear 18. The handle drive gear includes a series of handle drive teeth 18A that interact with a locking pawl 19 to restrain the handle drive gear from reverse rotation during the operating spring charging process as described in the aforementioned U.S. patent application Ser. No. 08/218,287. As described within the patent application, a two-stage operating springs latching assembly consisting of an intermediate latch 21 at the top of the handle drive gear 18 and a primary latch 20 arranged at the top of the intermediate latch interacts with the locking pawl 19 to prevent rotation of the closing shaft 33 while the operating spring is being charged. A pair of buttons 31, 32 are arranged on the top cover 12 to open and close the circuit breaker contacts, operation of which is depicted by the associated indicators 31A, 32A, respectively.

Figure 2:
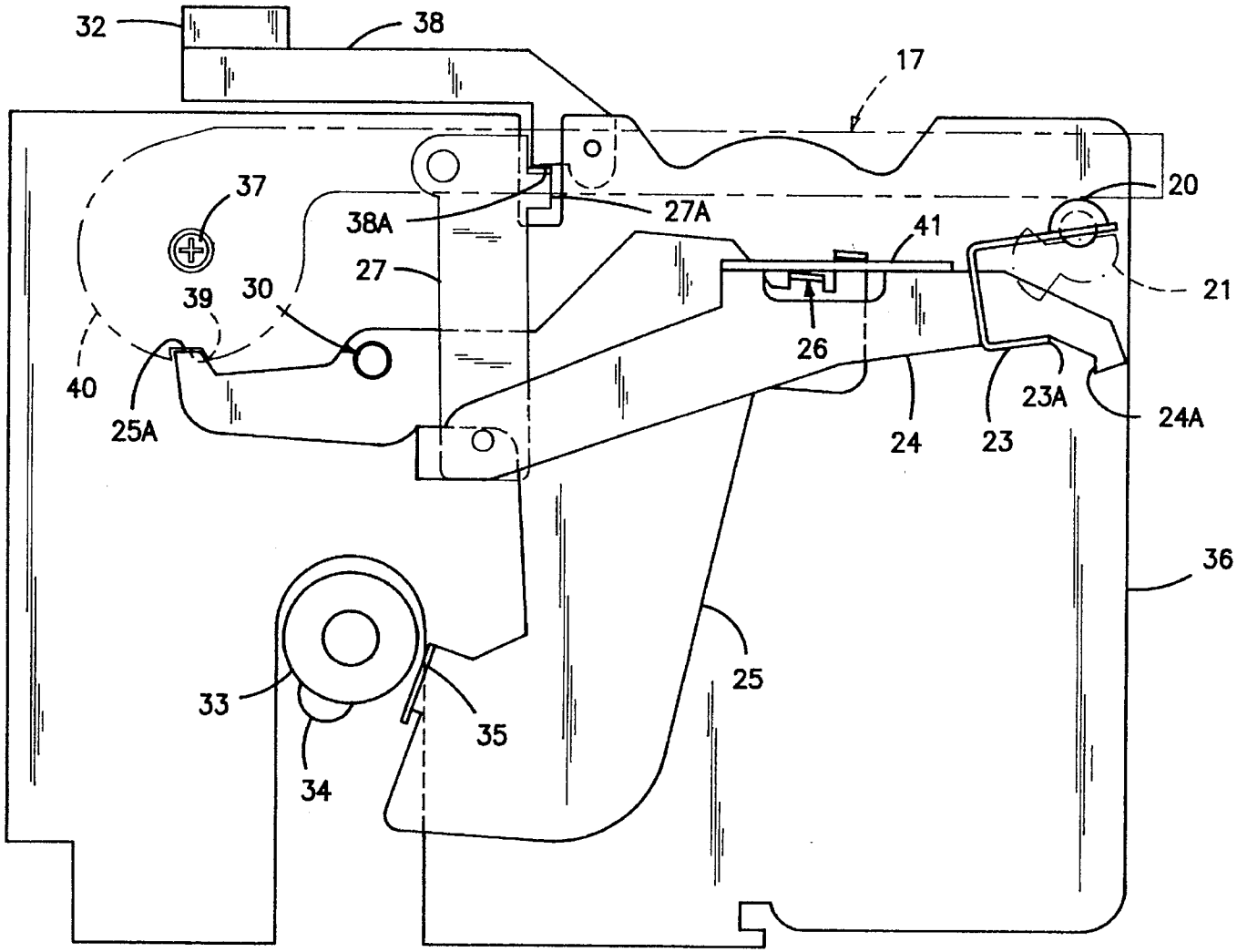
FIG. 2 is an enlarged plan side view of the operating handle interlock assembly within circuit breaker of FIG. 1 when the operating springs are fully charged and the operating handle is the retracted position.

In accordance with the teachings of this invention, the operating handle 17 is interlocked in order to prevent the operating mechanism spring from being released when the operating handle is extended. As shown in FIG. 2, the operating handle 17, shown in phantom, is attached to the operating mechanism sideframe 36 by means of the pivot 37 and is positioned in the completely retracted position with the operating spring 16 (FIG. 1) fully charged. The primary and intermediate latches 20, 21 are in their latched condition whereby the end 24A of the closing link 24 is away from the end 23A of the primary latch bracket 23 and the interlock tab 26 on the interlock link 25 is positionally arranged within the closing slot formed in the closing link 24. As described within the aforementioned U.S. patent application Ser. No. 08/218,287 the interlock tab 27A extending from interconnecting link 27 contacts the end 38A of the closing lever 38 when the close button 32 is depressed. The tab 25A on the end of the closing interlock link 25 which is pivotally attached to the sideframe 36 by pivot 30 is positioned within the slot 39 formed in the cam-shaped end 40 of the operating handle 17. With the protrusion 34 on the closing shaft 33 away from the positioning tab 35, the end 24A of the closing link 24 is in line with the end 23A of the primary latch bracket 23. Depressing the close button allows the end 24A of the closing link 24 to strike the end 23A of the primary latch bracket 23 thereby releasing the primary and intermediate latches 20, 21 allowing the operating mechanism spring to release and drive the circuit breaker contacts to their closed condition.

Figure 3:
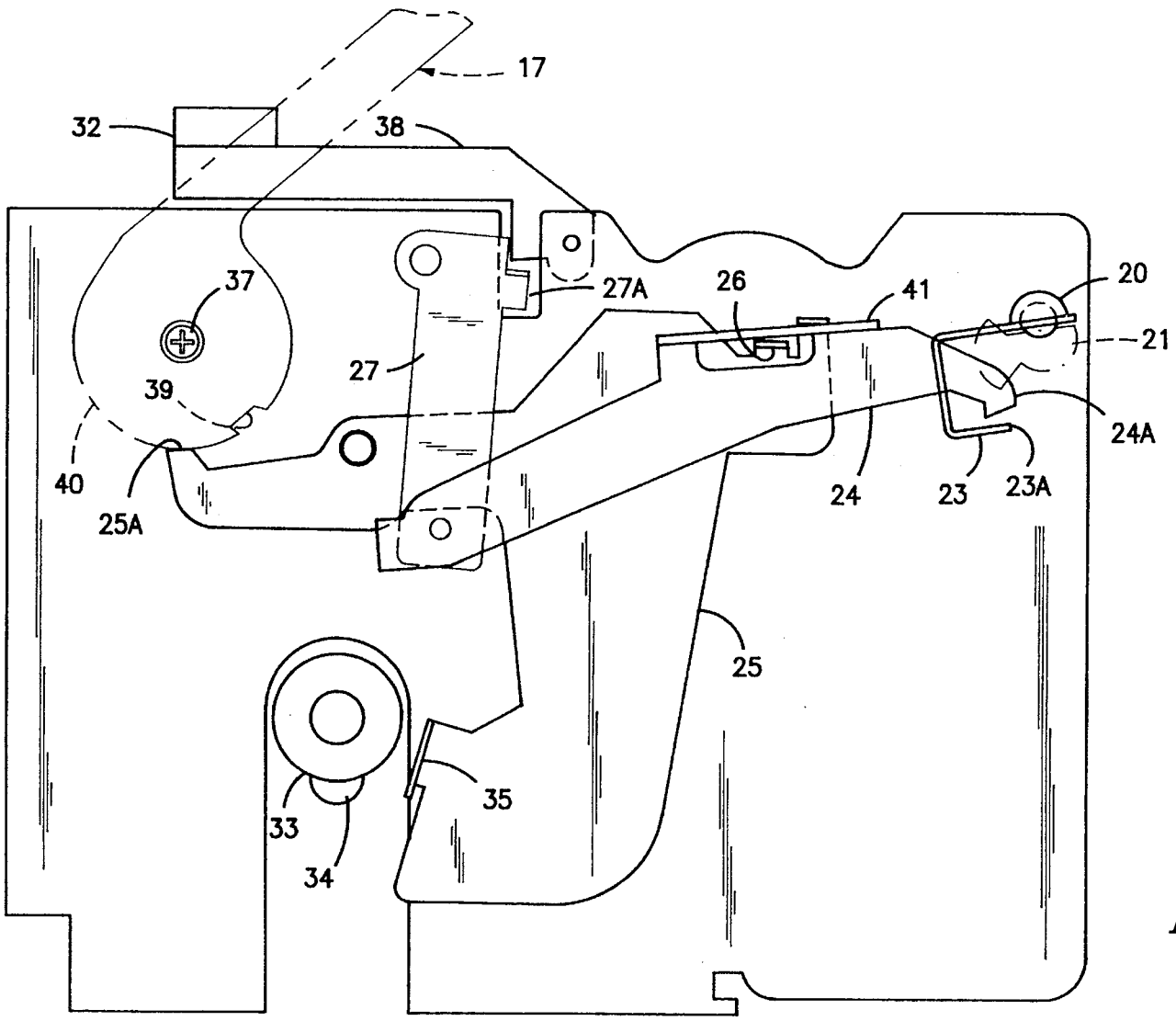
FIG. 3 is an enlarged plan side view of the operating handle interlock assembly of FIG. 2 when the operating springs are fully charged and the operating handle is in the extended position.

When the operating handle 17, shown in phantom in FIG. 3, is in the extended position and the operating spring 16 (FIG. 1) is fully charged, the primary and intermediate latches 20, 21 are in their latched condition as described earlier with reference to FIG. 2 and the tab 25A is outside the slot 39 and rests against the camming surface 40 of the operating handle 17. Depressing the close button 32 drives the closing lever 38 and the interconnecting link 27 in the clockwise direction and positions the end 24A of the closing link 24 out of line with the end 23A of the primary latch bracket 23 to prevent the end 24A of the closing link 24 from striking the end 23A of the primary latch bracket 23. The primary and secondary latches 20, 21 remain in the indicated latched position thereby preventing release of the mechanism spring. Returning the operating handle to the retracted position shown in FIG. 2, allows the tab 25A on the end of the closing interlock link 25 to become captured within the slot 39 within the camming surface 40 to position the end 24A of the closing link 24 in line with the end 23A of the primary latch bracket 23 to allow release of the primary and secondary latches 20, 21.

We claim:

1. An industrial-rated circuit breaker for high level overcurrent protection comprising:

an insulative base (11);

an insulative cover (12) above said base, said cover enclosing a closing shaft (33);

a closing spring (16) connecting with said closing shaft, said closing spring adapted for rotating said closing shaft and driving circuit breaker contacts to a closed condition;

close means (32) operatively connecting with said closing spring allowing an operator to release said closing spring for moving circuit breaker contacts to a closed condition;

a latching arrangement operatively connecting with said close means for preventing release of said operating spring until operation of said close means; and an externally-accessible operating handle allowing an operator to charge said closing spring, said handle including handle interlock means (40) interacting between said latching arrangement and said close means providing controllable release of said closing spring.

2. The circuit breaker of claim 1 wherein said latching arrangement includes a primary latch (20) and an intermediate latch (21).

3. The circuit breaker of claim 2 wherein said latching arrangement includes an interlock lever (25) and a closing link (24), one end of said closing link arranged for unlatching said latching arrangement and releasing said closing spring.

4. The circuit breaker of claim 3 wherein said a closing lever (38) connects with said close means at and with said closing link at an opposite end.

5. The circuit breaker of claim 3 including projection means (25A) on said interlock lever (25) interacting with said handle interlock means for preventing release of said closing spring when said operating handle is in an extended position.

6. The circuit breaker of claim 2 wherein said interlock means comprises a camming surface (40) formed at one end of said operating handle.

7. The circuit breaker of claim 6 including release means (39) provided on said camming surface, said release means receiving said projection means when said operating handle is in retracted position thereby allowing release of said closing spring when said close means is actuated.

8. The circuit breaker of claim 7 wherein said release means comprises a slot formed within said camming surface.

9. A circuit breaker handle interlock comprising:

an externally-accessible operating handle (17) arranged on a top surface of a circuit breaker cover (12) allowing an operator to charge a closing spring (16) subjacent said circuit breaker cover, said handle including handle interlock means (40) interacting between a latching arrangement restraining release of said closing spring and a close button providing controllable release of said closing spring.

10. The circuit breaker handle interlock of claim 9 wherein said interlock means comprises a camming surface (40) formed at one end of said operating handle, said camming surface extending within said circuit breaker cover and interacting with projection means (25A) on a circuit breaker interlock lever (25) for preventing release of said closing spring when said operating handle is in an extended position.

11. The circuit breaker handle interlock of claim 10 including release means (39) provided on said camming surface, said release means receiving said projection means when said operating handle is in retracted position thereby allowing release of said closing spring.

12. The circuit breaker handle interlock of claim 11 wherein said release means comprises a slot formed within said camming surface.

* * * * *